US006953012B2

(12) United States Patent
Hirano

(10) Patent No.: US 6,953,012 B2
(45) Date of Patent: Oct. 11, 2005

(54) FORCED OPENING AND CLOSING TYPE VALVE OPERATING SYSTEM

(75) Inventor: Makoto Hirano, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/967,182

(22) Filed: Oct. 19, 2004

(65) Prior Publication Data

US 2005/0132992 A1 Jun. 23, 2005

(30) Foreign Application Priority Data

Oct. 20, 2003 (JP) ..... 2003-359046

(51) Int. Cl.[7] ..... F01L 1/34

(52) U.S. Cl. ..... 123/90.16; 123/90.15; 123/90.24

(58) Field of Search ..... 123/90.24, 90.25, 123/90.16, 90.15

(56) References Cited

U.S. PATENT DOCUMENTS

| | | | | |
|---|---|---|---|---|
| 3,888,216 A | | 6/1975 | Miokovic | |
| 4,364,341 A | | 12/1982 | Holtmann | |
| 6,109,226 A | * | 8/2000 | Mote, Sr. | 123/90.24 |
| 6,311,659 B1 | | 11/2001 | Pierik | |
| 6,347,606 B1 | * | 2/2002 | Tanaka et al. | 123/90.16 |

FOREIGN PATENT DOCUMENTS

| | | |
|---|---|---|
| EP | 0 384 361 A2 | 8/1990 |
| GB | 961369 | 2/1961 |
| JP | 5-321617 A | 12/1993 |

* cited by examiner

*Primary Examiner*—Thomas Denion
*Assistant Examiner*—Zelalem Eshete
(74) *Attorney, Agent, or Firm*—Birch, Stewart, Kolasch & Birch, LLP

(57) ABSTRACT

A forced opening and closing valve operating system for changing the operating characteristics of an engine valve according to low speed running conditions and high speed running conditions of the engine, includes a low-speed free rocker arm that swings by following a low speed valve-opening cam and a low speed valve-closing cam, a high-speed free rocker arm that swings by following a high speed valve-opening cam and a high speed valve-closing cam, and a valve operating rocker arm that is sandwiched between the low-speed and high-speed free rocker arms and is connected to an engine valve for driving the engine valve in both valve-opening and valve-closing directions. The rocker arms are swingably supported on a rocker shaft. Connection switching means switches alternatively connecting the valve operating rocker arm to the low-speed and high-speed free rocker arms. Thus, the valve operating system is compact, and noise generation is prevented.

20 Claims, 5 Drawing Sheets

FORCED OPENING AND CLOSING TYPE VALVE OPERATING SYSTEM

CROSS-REFERENCE TO RELATED APPLICATION

The present application claims priority under 35 U.S.C. §119 to Japanese Patent Application No. 2003-359046, filed Oct. 20, 2003, the entire contents of which are hereby incorporated by reference.

BACKGROUND OF THE INVENTION

1. Field of the Invention

The present invention relates to a forced opening and closing valve operating system in which an engine valve is forcibly operated during valve opening and valve closing, and more particularly to a forced opening and closing valve operating system in which the operating characteristics of an engine valve are changed according to low speed running conditions and high speed running conditions of the engine.

2. Description of Related Art

A forced opening and closing valve operating system in which the operating characteristics of an engine valve are changed according to low speed running conditions and high speed running conditions of the engine is already known from, for example, Japanese Patent Application Laid-open No. 5-321617.

In this conventional forced opening and closing valve operating system, a rocker shaft having two different eccentric portions is supported in a cylinder head so that the rocker shaft can undergo angular displacement around its axis, and a low speed opening rocker arm is connected to an engine valve which is either an intake valve or an exhaust valve, so as to exert on the engine valve a driving force in a valve-opening direction, the low speed opening rocker arm being supported on a non-eccentric portion of the rocker shaft so as to swing by following a low speed valve-opening cam.

Further, a low speed closing rocker arm is connected to the engine valve so as to exert on the engine valve a driving force in a valve-closing direction, the low speed closing rocker arm being supported on one of the eccentric portions of the rocker shaft so as to swing by following a low speed valve-closing cam. Both a high speed opening rocker arm which can swing by following a high speed valve-opening cam and can exert a force in a valve-opening direction on the low speed opening rocker arm while swinging, and a high speed closing rocker arm which can swing by following a high speed valve-closing cam and can exert a force in a valve-closing direction on the low speed closing rocker arm while swinging, are supported on the other one of the eccentric-portions of the rocker shaft. The rocker shaft undergoes angular displacement so that the rocker arms are made to come into sliding contact with the corresponding cams or separate therefrom, thus forcibly opening or closing the engine valve while changing the valve operating characteristics according to the running conditions of the engine.

However, in such a conventional forced opening and closing valve operating system, it is necessary to secure a space in the cylinder head for the rocker arms to come into sliding contact with the corresponding cams or separate therefrom for the angular displacement of the rocker shaft, and the dimensions of the cylinder head increase accordingly. Furthermore, in order to make the operating characteristics of the engine valve change according to low speed running conditions and high speed running conditions of the engine, at least four rocker arms are required, that is, the number of components cannot be said to be small, and it is necessary to secure a space for these rocker arms to be arranged along the axial direction of the rocker shaft, which also increases the dimensions of the cylinder head. Moreover, noise, such as knocking sound, is caused when the rocker arms come into sliding contact with and separate from the corresponding cams.

SUMMARY OF THE INVENTION

The present invention has been achieved under the above-mentioned circumstances, and it is an object thereof to provide a forced opening and closing valve operating system that can be made compact in order to reduce the dimensions of a cylinder head, and that can prevent generation of noise.

In order to attain this object, in accordance with a first aspect of the present invention, there is proposed a forced opening and closing valve operating system comprising: a camshaft including a low speed valve-opening cam, a low speed valve-closing cam, a high speed valve-opening cam, and a high speed valve-closing cam, the low speed valve-opening cam and the low speed valve-closing cam have profiles corresponding to low speed running of an engine, and the high speed valve-opening cam and the high speed valve-closing cam having profiles corresponding to high speed running of the engine.

Also provided are a rocker shaft having an axis parallel to the camshaft; a low-speed free rocker arm supported on the rocker shaft so as to swing by following the low speed valve-opening cam and the low speed valve-closing cam; a high-speed free rocker arm supported on the rocker shaft so as to swing by following the high speed valve-opening cam and the high speed valve-closing cam; a valve operating rocker arm swingably supported by the rocker shaft between the low-speed and high-speed free rocker arms, and connected to an engine valve so as to drive the engine valve in both valve-opening and valve-closing directions; and connection switching means provided in the rocker arms, the connection switching means switching so that the valve operating rocker arm is connected alternatively to the low-speed and high-speed free rocker arms.

Furthermore, in accordance with a second aspect of the present invention, the connection switching means includes a connecting piston that having opposite ends facing a pair of hydraulic chambers while being capable of sliding in parallel to the axis of the rocker shaft between a position in which it provides a connection between the valve operating rocker arm and the low-speed free rocker arm and a position in which it provides a connection between the valve operating rocker arm and the high-speed free rocker arm, and a control valve is connected to the two hydraulic chambers, the control valve switching alternatively between a state in which hydraulic pressure of a hydraulic pressure source is made to act and a state in which the hydraulic pressure is released.

In accordance with the first aspect of the present invention, the engine valve is forcibly opened and closed by swinging of the valve operating rocker arm. When the engine is running at low speed, the low-speed free rocker arm which swings by following the low speed valve-opening cam and the low speed valve-closing cam, is connected to the valve operating rocker arm by the connection switching means, thus enabling the valve operating rocker arm to swing integrally with the low-speed free rocker arm. Therefore, it is possible to forcibly open and close the engine valve with operating characteristics corresponding to the low speed running of the engine.

In this process, the high-speed free rocker arm swings freely following the high speed valve-opening cam and the high speed valve-closing cam without interfering with the operation of the engine valve. When the engine is running at high speed, the high-speed free rocker arm which swings by following the high speed valve-opening cam and the high speed valve-closing cam, is connected to the valve operating rocker arm by the connection switching means, thus enabling the valve operating rocker arm to swing integrally with the high-speed free rocker arm. Therefore, it is possible to forcibly open and close the engine valve with operating characteristics corresponding to the high speed running of the engine.

In this process, the low-speed free rocker arm swings freely following the low speed valve-opening cam and the low speed valve-closing cam without interfering with the operation of the engine valve. That is, by switching alternatively between connection of the valve operating rocker arm to the low-speed free rocker arm and to the high-speed free rocker arm, it is possible to forcibly open and close the engine valve with operating characteristics corresponding to low speed or high speed running of the engine, thereby providing, with a simple structure having a reduced number of components, a forced opening and closing valve operating system in which the operating characteristics of the engine valve are changed according to low speed running conditions and high speed running conditions of the engine.

Moreover, since it is unnecessary to secure a space for the rocker arms to come into sliding contact with and separate from the corresponding cams, the valve operating system can be made compact, thereby contributing to a reduction in the dimensions of the cylinder head.

Furthermore, since the low-speed free rocker arm is always in contact with the low speed valve-opening cam and the low speed valve-closing cam, and the high-speed free rocker arm is always in contact with the high speed valve-opening cam and the high speed valve-closing cam, it is possible to prevent generation of knocking sound.

In accordance with the second aspect of the present invention, since switching operation of the connection switching means is carried out by controlling the hydraulic pressure acting on opposite end faces of the connecting piston, it is unnecessary to use a return spring for urging the connecting piston axially in one direction, thus reducing the number of components.

Moreover, since it is unnecessary to output, from the hydraulic pressure source, a hydraulic pressure that counteracts the urging force of the return spring, it is possible to set the output hydraulic pressure of the hydraulic pressure source at a relatively low level, thus improving the output efficiency of the engine.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF PREFERRED EMBODIMENT OF THE INVENTION

Figure 1:
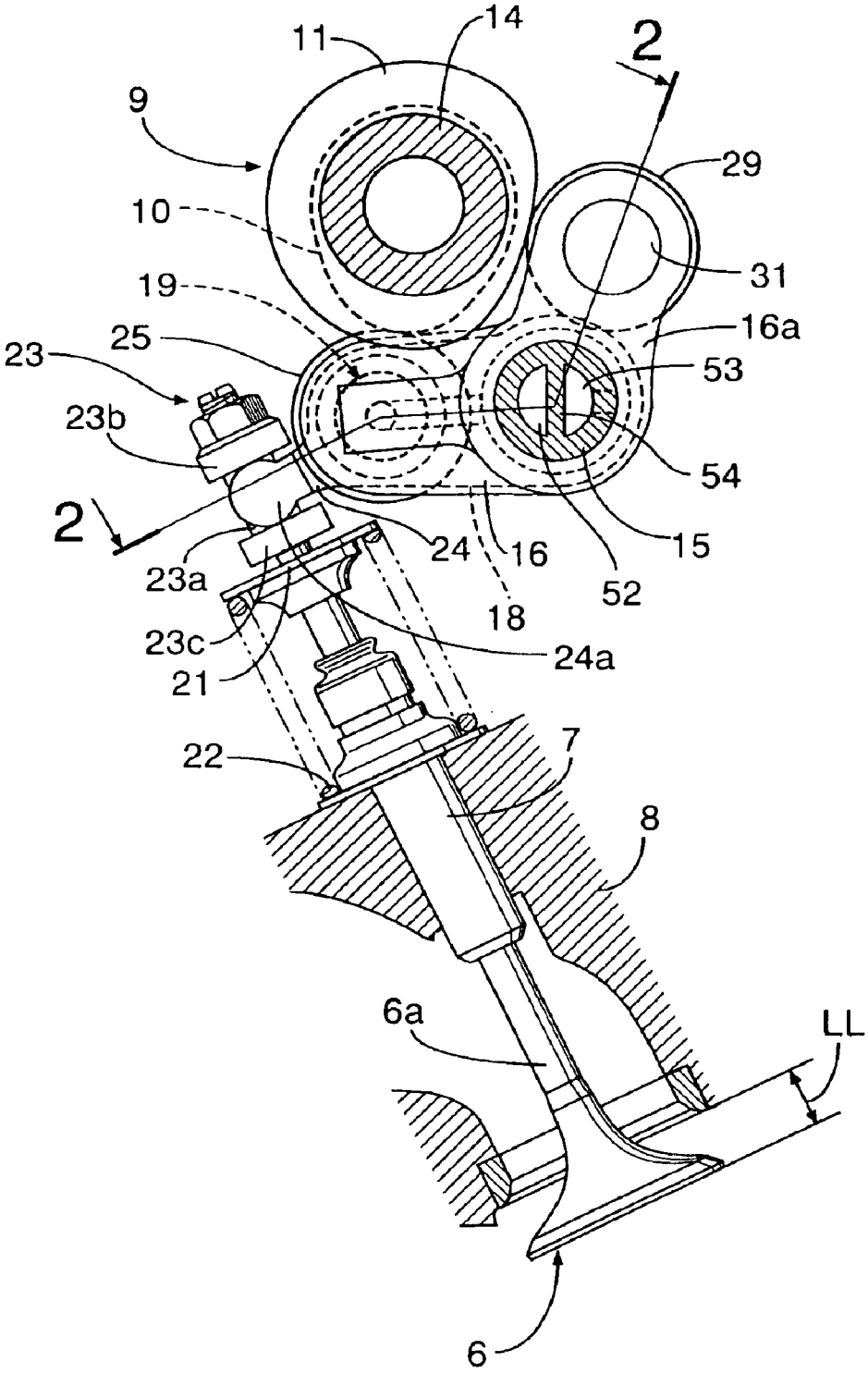
FIG. 1 is a vertical sectional view of a forced opening and closing valve operating system according to one embodiment of the present invention when running at low speed, and also is a sectional view along line 1—1 in FIG. 2.

Referring firstly to FIG. 1 to FIG. 4, provided in a cylinder head 8 are guide tubes 7 into which valve stems 6*a* of intake valves 6 serving as a pair of engine valves are slidably fitted. The intake valves 6 are forcibly opened and closed by a forced opening and closing valve operating system 9 according to the present invention so that operating characteristics of the two intake valves 6 are changed between low speed running conditions and high speed running conditions of an engine.

The forced opening and closing valve operating system 9 includes: a camshaft 14 having a low speed valve-opening cam 10, a low speed valve-closing cam 11, a high speed valve-opening cam 12, a high speed valve-closing cam 13, the low speed valve-opening cam 10 and the low speed valve-closing cam 11 having profiles corresponding to low speed running of the engine, the high speed valve-opening cam 12 and the high speed valve-closing cam 13 having profiles corresponding to high speed running of the engine.

Also provided are a rocker shaft 15 having an axis parallel to the camshaft 14; a low-speed free rocker arm 16 supported on the rocker shaft 15 so as to swing by following the low speed valve-opening cam 10 and the low speed valve-closing cam 11; a high-speed free rocker arm 17 supported on the rocker shaft 15 so as to swing by following the high speed valve-opening cam 12 and the high speed valve-closing cam 13; a valve operating rocker arm 18 swingably supported on the rocker shaft 15 between the low-speed and high-speed free rocker arms 16 and 17; and connection switching means 19 provided on the rocker arms 16, 17, and 18, the connection switching means 19 switching so that the valve operating rocker arm 18 is connected alternatively to the low-speed and high-speed free rocker arms 16 and 17.

Retainers 21 are mounted on upper parts of the valve stems 6*a* of the two intake valves 6. Springs 22 urging the intake valves 6 in a valve-closing direction are disposed between the cylinder head 8 and the retainers 21. Since the intake valves 6 are forcibly opened and closed and are not closed by the spring force of the springs 22, the spring load of the springs 22 may be set at such a small level that can maintain the positions of the intake valves 6 during assembly.

Latching members 23 are mounted at upper end parts of the valve stems 6*a* above the retainers 21 in such a manner that axial positions of the latching members 23 are adjustable. The latching member 23 integrally has a connecting tube portion 23*a* which is coaxial with the valve stem 6*a*, an upper collar portion 23*b* which projects radially outward from the upper end of the connecting tube portion 23*a*, and a lower collar portion 23*c* which projects radially outward from the lower end of the connecting tube portion 23*a*.

Provided integrally with the valve operating rocker arm 18 is a substantially T-shaped engagement arm 24 extending toward the two intake valves 6. Formed integrally with opposite ends of the engagement arm 24 are substantially U-shaped engagement portions 24*a*, which engage with the latching members 23 by being inserted between the upper collar portions 23*b* and the lower collar portions 23*c* of the latching members 23. That is, the valve operating rocker arm 18 swingably supported on the rocker shaft 15 is connected to the two intake valves 6 so that the two intake valves 6 are driven in both the valve-opening direction and the valve-closing direction when the valve operating rocker arm 18 swings.

The rotational power from a crankshaft, which is not illustrated, is transmitted at a reduction ratio of 1/2 to the camshaft 14 disposed above a middle part between upper parts of the two intake valves 6 and the rocker shaft 15. The low speed valve-opening cam 10 and the low speed valve-closing cam 11 are provided on the camshaft 14 at positions corresponding to the low-speed free rocker arm 16 such that the low speed valve-opening cam 10 is disposed on the valve operating rocker arm 18 side relative to the low speed valve-closing cam 11. The high speed valve-opening cam 12 and the high speed valve-closing cam 13 are provided on the camshaft 14 at positions corresponding to the high-speed free rocker arm 17 such that the high speed valve-opening cam 12 is disposed on the valve operating rocker arm 18 side relative to the high speed valve-closing cam 13.

The low-speed free rocker arm 16 is swingably supported on the rocker shaft 15 so that it comes into sliding contact with the valve operating rocker arm 18 from one side along the axis of the rocker shaft 15. A valve opening roller 25 which is in rolling contact with the low speed valve-opening cam 10 on the camshaft 14 is axially supported on the low-speed free rocker arm 16. That is, an opening 26 for receiving the valve-opening roller 25 is provided in the low-speed free rocker arm 16 beneath the camshaft 14. The opening 26 is substantially U-shaped and opens toward the intake valve 6 in plan view. A support shaft 27 having an axis parallel to the rocker shaft 15 is secured by press fitting, etc. into the low-speed free rocker arm 16 across the opening 26. The valve opening roller 25 is rotatably supported on the support shaft 27 via a roller bearing 28. The support shaft 27 is secured to the low-speed free rocker arm 16 so that the end face of the support shaft 27 on the valve operating rocker arm 18 side does not project from the side face of the low-speed free rocker arm 16 on the valve operating rocker arm 18 side.

A support arm portion 16*a* is provided integrally with the low-speed free rocker arm 16 at a position corresponding to the low speed valve-closing cam 11, the support arm portion 16*a* rising upward from a portion of the low-speed free rocker arm 16 supported by the rocker shaft 15. A valve closing roller 29, which is in rolling contact with the low speed valve-closing cam 11, is axially supported by the support arm portion 16*a*. That is, an opening 30 for receiving the valve closing roller 29 is provided in an upper end part of the support arm portion 16*a*. The opening 30 is substantially U-shaped and opens toward the side opposite to the rocker shaft 15 when viewed from the camshaft 14 side. A support shaft 31 having an axis parallel to the rocker shaft 15 is secured by press fitting, etc. into the support arm portion 16*a* across the opening 30. The valve closing roller 29 is rotatably supported on the support shaft 31 via a roller bearing 32.

The high-speed free rocker arm 17 is swingably supported by the rocker shaft 15 so as to be in sliding contact with the valve operating rocker arm 18 from the other side along the axis of the rocker shaft 15. A valve opening roller 35 which is in rolling contact with the high speed valve-opening cam 12 on the camshaft 14, is axially supported on the high-speed free rocker arm 17. That is, an opening 36 for receiving the valve opening roller 35 is provided in the high-speed free rocker arm 17 beneath the camshaft 14. The opening 36 is substantially U-shaped and opens toward the intake valve 6 in plan view. A support shaft 37 having an axis parallel to the rocker shaft 15 is secured by press fitting, etc. into the high-speed free rocker arm 17 across the opening 36. The valve opening roller 35 is rotatably supported on the support shaft 37 via a roller bearing 38. The support shaft 37 is secured to the high-speed free rocker arm 17 so that the end face of the support shaft 37 on the valve operating rocker arm 18 side does not project from the side face of the high-speed free rocker arm 17 on the valve operating rocker arm 18 side.

A support arm portion 17*a* is provided integrally with the high-speed free rocker arm 17 at a position corresponding to the high speed valve-closing cam 13, the support arm portion 17*a* rising upward from a portion of the high-speed free rocker arm 17 supported by the rocker shaft 15. A valve closing roller 39 which is in rolling contact with the high speed valve-closing cam 13, is axially supported on the support arm portion 17*a*. That is, an opening 40 for receiving the valve closing roller 39 is provided in an upper end part of the support arm portion 17*a*. The opening 40 is substantially U-shaped and opens toward the side opposite to the rocker shaft 15 when viewed from the camshaft 14 side. A support shaft 41 having an axis parallel to the rocker shaft 15 is secured by press fitting, etc. into the support arm portion 17*a* across the opening 40. The valve closing roller 39 is rotatably supported on the support shaft 41 via a roller bearing 42.

The connection switching means 19 includes a connecting piston 44 that can slide parallel to the axis of the rocker shaft 15 between a position (the position shown in FIG. 2) at which the valve operating rocker arm 18 and the low-speed free rocker arm 16 are connected and a position (the position shown in FIG. 4) at which the valve operating rocker arm 18 and the high-speed free rocker arm 17 are connected.

A slide hole 45 having an axis parallel to the rocker shaft 15 is provided in the valve operating rocker arm 18 in a portion corresponding to the valve opening rollers 25 and 35 of the low-speed and high-speed free rocker arms 16 and 17 so that opposite ends of the slide hole 45 are open, and the connecting piston 44 is slidably fitted into the slide hole 45. A bottomed first mating hole 46 is provided in the support shaft 27 which axially supports the valve opening roller 25 in the low-speed free rocker arm 16 so that the first mating hole 46 communicates coaxially with the slide hole 45 when the intake valves 6 are in a valve-closed cut-off state.

The first mating hole 46 is formed so as to have the same diameter as that of the slide hole 45 so that one end part of the connecting piston 44 can be fitted into the first mating hole 46. A bottomed second mating hole 47 is provided in the support shaft 37 which axially supports the valve opening roller 35 in the high-speed free rocker arm 17 so that the second mating hole 47 communicates coaxially with the slide hole 45 when the intake valves 6 are in a valve-closed cut-off state. The second mating hole 47 is formed so as to have the same diameter as that of the slide hole 45 so that one end part of the connecting piston 44 can be fitted into the second mating hole 47.

Annular first and second steps 46*a* and 47*a* facing the valve operating rocker arm 18 side are formed in middle parts of the first and second mating holes 46 and 47, respectively. The connecting piston 44 provides a connection between the valve operating rocker arm 18 and the low-speed free rocker arm 16 when the connecting piston 44 is fitted into the first mating hole 46 until it abuts against the first step 46*a*, and provides a connection between the valve operating rocker arm 18 and the high-speed free rocker arm 17 when the connecting piston 44 is fitted into the second mating hole 47 until it abuts against the second step 47*a*.

A high-speed hydraulic chamber 48, which faces one end face of the connecting piston 44, is formed in the low-speed free rocker arm 16 and the valve operating rocker arm 18. A low-speed hydraulic chamber 49, which faces the other end face of the connecting piston 44, is formed in the high-speed free rocker arm 17 and the valve operating rocker arm 18.

Applying hydraulic pressure to the low-speed hydraulic chamber 49 to release the hydraulic pressure exerted on the high-speed hydraulic chamber 48 allows the connecting piston 44 to move toward the side where the low-speed free rocker arm 16 and the valve operating rocker arm 18 are connected. Applying hydraulic pressure to the high-speed hydraulic chamber 48 to release the hydraulic pressure exerted on the low-speed hydraulic chamber 49 allows the connecting piston 44 to move to the side where the high-speed free rocker arm 17 and the valve operating rocker arm 18 are connected.

A ring-shaped first seal 50 is mounted on a side face of the valve operating rocker arm 18 that is in sliding contact with the low-speed free rocker arm 16, the ring-shaped first seal 50 coaxially surrounding the slide hole 45 and being arranged with a span such that it surrounds the first mating hole 46 even when the low-speed free rocker arm 16 swings relative to the valve operating rocker arm 18. A ring-shaped second seal 51 is mounted on a side face of the valve operating rocker arm 18 that is in sliding contact with the high-speed free rocker arm 17, the ring-shaped second seal 51 coaxially surrounding the slide hole 45 and being arranged with a span such that it surrounds the second mating hole 47 even when the high-speed free rocker arm 17 swings relative to the valve operating rocker arm 18.

A dividing member 54 is inserted into and secured to the interior of the rocker shaft 15 so as to divide the interior of the rocker shaft 15 into a low-speed oil passage 52 and a high-speed oil passage 53. Provided in the high-speed free rocker arm 17 are a low-speed communication passage 55, one end of which communicates with the low-speed hydraulic chamber 49, and a low-speed annular recess 56, which is formed into an annular shape so as to surround the rocker shaft 15 and which communicates with the low-speed communication passage 55.

Provided in the rocker shaft 15 is a low-speed communication hole 57 always providing communication between the low-speed oil passage 52 and the low-speed annular recess 56. Provided in the low-speed free rocker arm 16 are a high-speed communication passage 58, one end of which communicates with the high-speed hydraulic chamber 48, and a high-speed annular recess 59, which is formed into an annular shape so as to surround the rocker shaft 15 and which communicates with the high-speed communication passage 58. Provided in the rocker shaft 15 is a high-speed communication hole 60 always providing communication between the high-speed oil passage 53 and the high-speed annular recess 59.

A control valve 63 is connected to the two hydraulic chambers 48 and 49 of the connection switching means 19 to switch alternatively between a state in which the hydraulic pressure of a pump 61, which is a hydraulic pressure source, is made to act and a state in which the hydraulic pressure is released. That is, the provision and cut off of communication from the low-speed oil passage 52 and the high-speed oil passage 53 within the rocker shaft 15 to the pump 61 and the reservoir 62 can be switched alternatively by the control valve 63.

Specifically, the control valve 63 switches alternatively between a state in which the hydraulic pressure of the pump 61 is made to act on one of the two oil passages 52 and 53 and the hydraulic pressure is released from the other one of the two oil passage 52 and 53, and a state in which the hydraulic pressure of the pump 61 is made to act on said other one of the two oil passages 52 and 53 and the hydraulic pressure is released from said one of the two oil passage 52 and 53.

The pump 61 may be a crankshaft-driven oil pump for feeding lubricating oil to a lubrication part of the engine or a pump driven by an electric motor independent from the engine.

The switching operation of the control valve 63 is controlled by a control unit 64. The control unit 64 determines the running conditions of the engine from detection results such as the engine rotational speed and the engine load: when it is determined that the engine is running under low speed running conditions, it controls the control valve 63 so that hydraulic pressure discharged from the pump 61 acts on the low-speed oil passage 52; and when it is determined that the engine is running under high speed running conditions, it controls the control valve 63 so that hydraulic pressure discharged from the pump 61 acts on the high-speed oil passage 53.

If the hydraulic pressure from the pump 61 is made to act on the low-speed oil passage 52 in low speed engine running conditions to release the hydraulic pressure of the high-speed oil passage 53, the connecting piston 44 of the connection switching means 19 immediately slides to the low-speed free rocker arm 16 side.

However, in a state in which the valve operating rocker arm 18 and the low-speed free rocker arm 16 have swung relative to each other, said one end of the connecting piston 44 is in sliding contact with the side face of the low-speed free rocker arm 16 on the valve operating rocker arm 18 side, and it engages with the first mating hole 46 when the intake valves 6 are in a valve-closed cut-off state and the slide hole 45 and the first mating hole 46 communicate coaxially with each other, thus providing a connection between the valve operating rocker arm 18 and the low-speed free rocker arm 16. If the hydraulic pressure from the pump 61 is made to act on the high-speed oil passage 53 in high speed engine running conditions to release the hydraulic pressure of the low-speed oil passage 52, the connecting piston 44 of the connection switching means 19 immediately slides to the high-speed free rocker arm 17 side.

However, in a state in which the valve operating rocker arm 18 and the high-speed free rocker arm 17 have swung relative to each other, said other end of the connecting piston 44 is in sliding contact with the side face of the high-speed free rocker arm 17 on the valve operating rocker arm 18 side, and it engages with the second mating hole 47 when the intake valves 6 are in the valve-closed cut-off state and the slide hole 45 and the second mating hole 47 communicate coaxially with each other, thus providing a connection between the valve operating rocker arm 18 and the high-speed free rocker arm 17.

The operation of this embodiment is now explained. The rocker shaft 15 swingably supports: the low-speed free rocker arm 16 which swings by following the low speed valve-opening cam 10 and the low speed valve-closing cam 11 that are provided on the camshaft 14 and that have profiles corresponding to low speed running of the engine; the high-speed free rocker arm 17 which swings by following the high speed valve-opening cam 12 and the high speed valve-closing cam 13 that are provided on the camshaft 14 and that have profiles corresponding to high speed running of the engine; and the valve operating rocker arm 18 which is sandwiched between the low-speed and high-speed free rocker arms 16 and 17.

The low-speed and high-speed free rocker arms 16 and 17 can be connected alternatively to the valve operating rocker arm 18 by being switched by the connection switching means 19. The valve operating rocker arm 18 is connected to the two intake valves 6 so as to drive the pair of intake valves 6 in both the valve-opening direction and the valve-closing direction.

Figure 2:
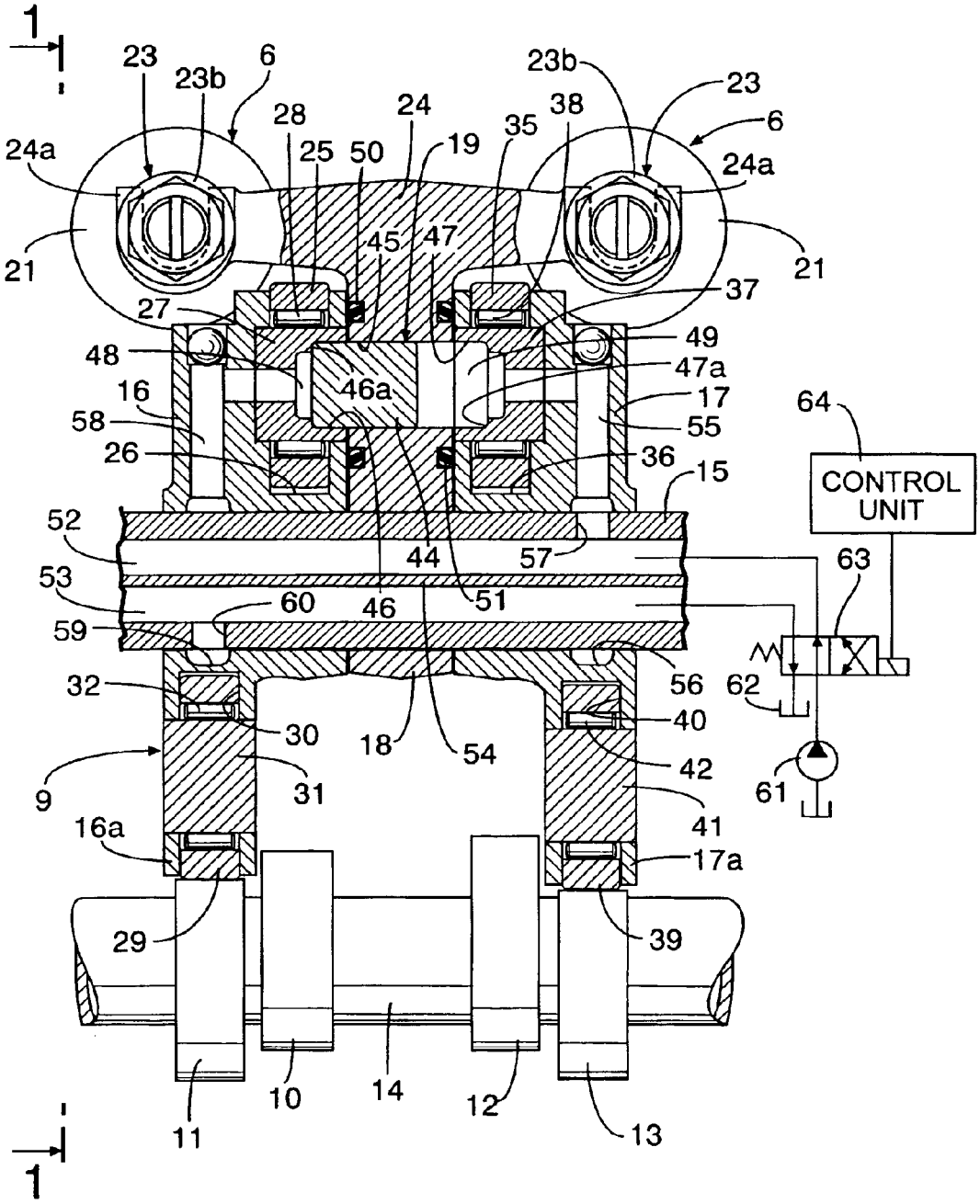
FIG. 2 is a sectional view showing correspondence between rocker arms and cams, which are sectioned along line 2—2 in FIG. 1.

Therefore, when the engine is running at low speed as shown in FIG. 2, the low-speed free rocker arm 16 which swings by following the low speed valve-opening cam 10 and the low speed valve-closing cam 11 is connected to the valve operating rocker arm 18 via the connection switching means 19 so as to make the valve operating rocker arm 18 swing integrally with the low-speed free rocker arm 16, and the two intake valves 6 are forcibly opened and closed with operating characteristics corresponding to low speed running of the engine in which the valve-opening lift of the intake valves 6 is a relatively small value LL as shown in FIG. 1.

In this process, the high-speed free rocker arm 17 follows the high speed valve-opening cam 12 and the high speed valve-closing cam 13, and swings freely without interfering with the operation of the two intake valves 6.

Figure 3:
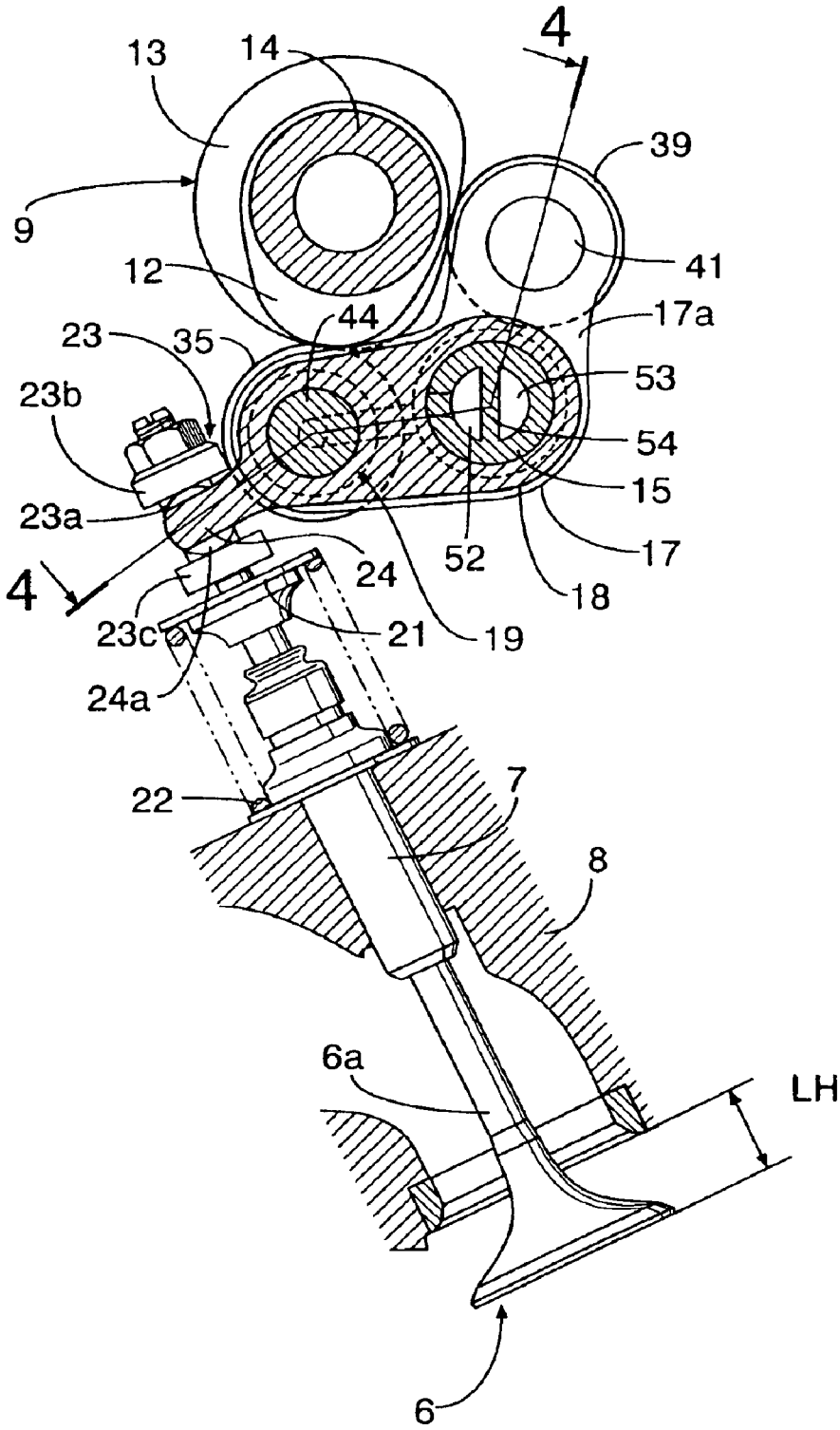
FIG. 3 is a vertical sectional view of the forced opening and closing valve operating system when running at high speed, and also is a sectional view along line 3—3 in FIG. 4.
Figure 4:
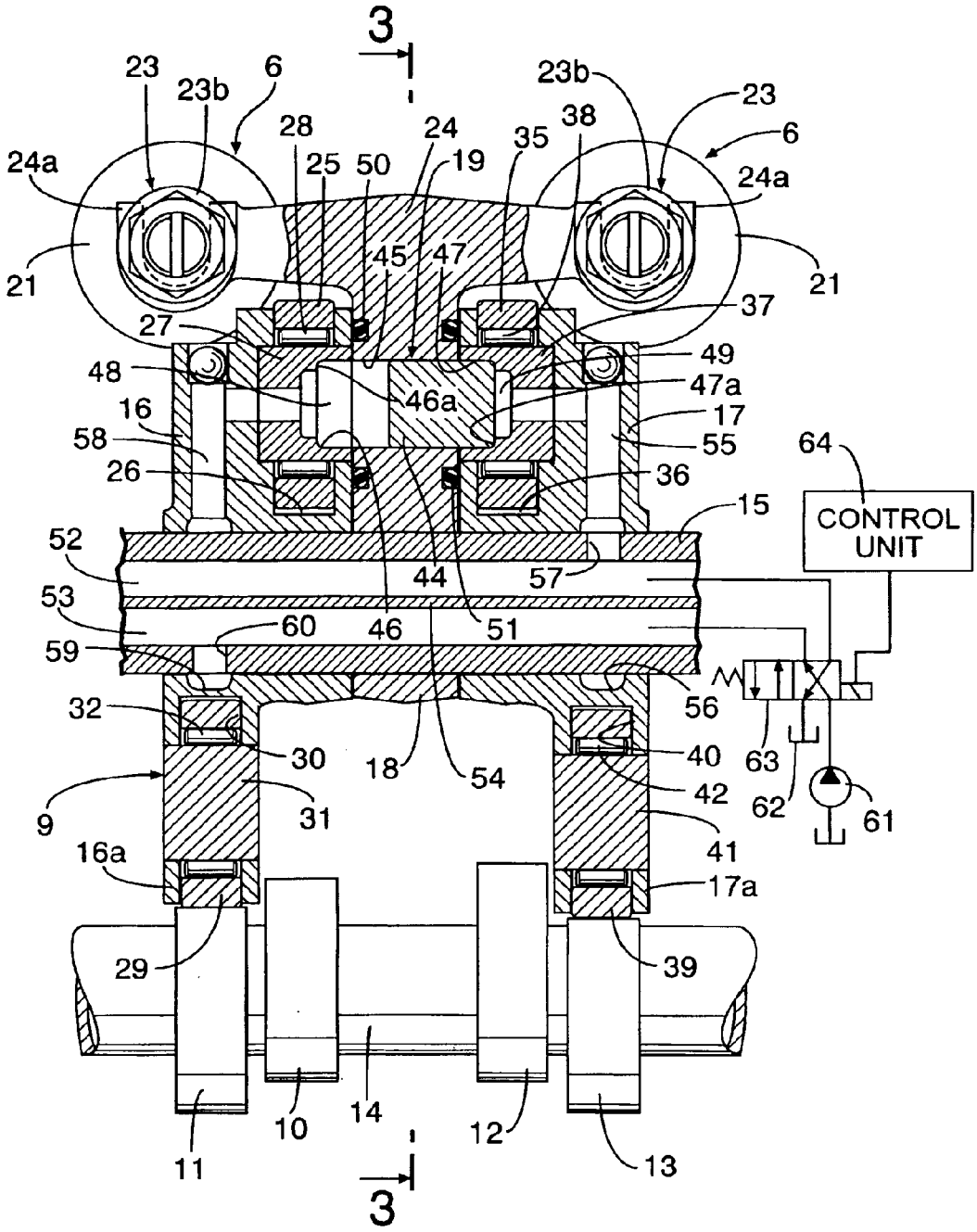
FIG. 4 is a sectional view showing correspondence between the rocker arms and the cams, which are sectioned along line 4—4 in FIG. 3.

When the engine is running at high speed as shown in FIG. 4, the high-speed free rocker arm 17 which swings by following the high speed valve-opening cam 12 and the high speed valve-closing cam 13 is connected to the valve operating rocker arm 18 via the connection switching means 19 so as to make the valve operating rocker arm 18 swing integrally with the high-speed free rocker arm 17, and the two intake valves 6 are forcibly opened and closed with operating characteristics corresponding to high speed running of the engine in which the valve-opening lift of the intake valves 6 is a relatively large value LH as shown in FIG. 3.

In this process, the low-speed free rocker arm 16 follows the low speed valve-opening cam 10 and the low speed valve-closing cam 11, and swings freely without interfering with the operation of the two intake valves 6.

In this way, by forcibly opening and closing the pair of intake valves 6, it is possible to set the load of the valve springs 22 at a small value, thus suppressing frictional loss due to the valve springs 22 to contribute to increase of the output. Furthermore, since the intake valves 6 are not closed by the valve springs 22, it is possible to eliminate any uncertainty in the valve-closing operation by the valve springs 22 in a high rotational speed region.

By switching the connection of the valve operating rocker arm 18 alternatively to the low-speed free rocker arm 16 and the high-speed free rocker arm 17, the operating characteristics of the intake valves 6 are changed between the low speed running conditions and the high speed running conditions of the engine, and it is thus possible to form the forced opening and closing valve operating system 9 with a simple structure having a smaller number of components.

Figure 5:
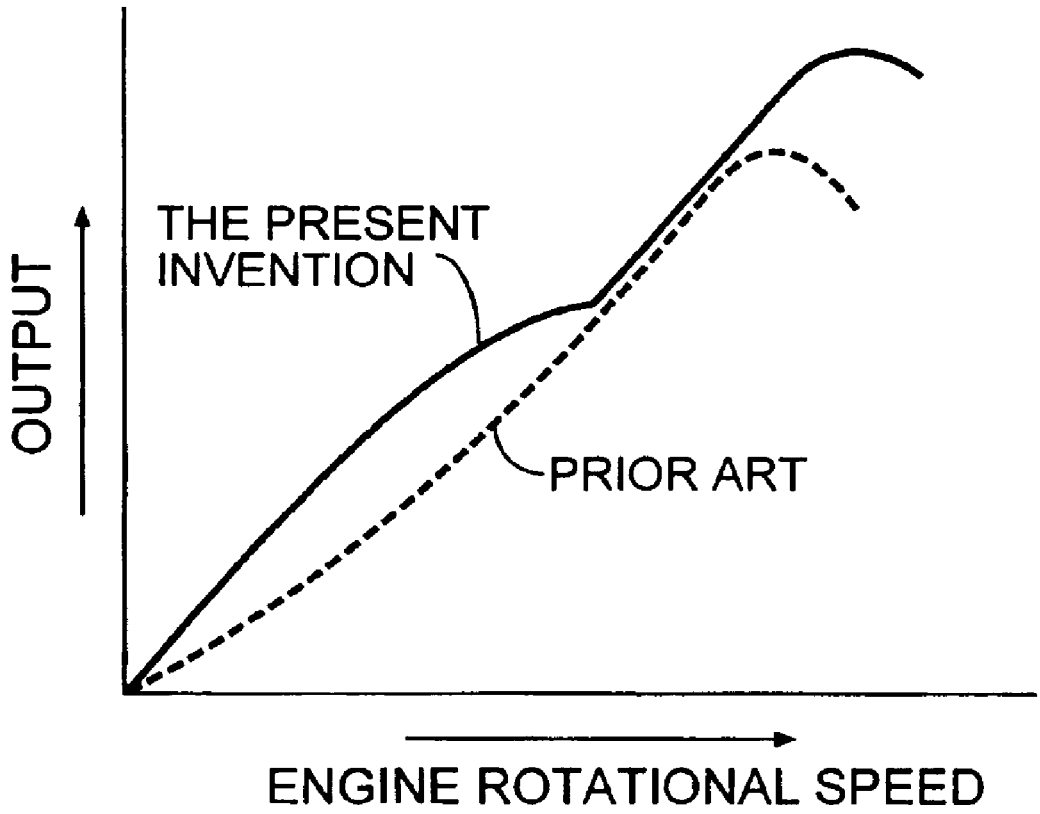
FIG. 5 is a diagram showing engine output characteristics.

Moreover, as shown by the solid line in FIG. 5, the intake valves 6 can be forcibly opened and closed with operating characteristics corresponding to low speed and high speed running of the engine, and thus the engine output can be improved over a wide range from low speed to high speed in comparison with a conventional arrangement shown by the broken line in FIG. 5 in which the valve operating characteristics are not changed.

Furthermore, since it is unnecessary to secure a space for the low-speed and high-speed free rocker arms 16 and 17 to come into sliding contact with the corresponding cams 10, 11, 12, and 13 and separate therefrom, it is possible to make compact the forced opening and closing valve operating system 9, thereby contributing to a reduction in the dimensions of the cylinder head 8.

Moreover, since the low-speed free rocker arm 16 is always in contact with the low speed valve-opening cam 10 and the low speed valve-closing cam 11, and the high-speed free rocker arm 17 is always in contact with the high speed valve-opening cam 12 and the high speed valve-closing cam 13, it is possible to prevent generation of knocking sound.

Furthermore, the connection switching means 19 includes the connecting piston 44 having opposite ends thereof facing the pair of hydraulic chambers 48 and 49 while being capable of sliding in parallel to the axis of the rocker shaft 15 between the position in which it provides a connection between the valve operating rocker arm 18 and the low-speed free rocker arm 16 and the position in which it provides a connection between the valve operating rocker arm 18 and the high-speed free rocker arm 17. Also, the control valve 63 which switches alternatively between a state in which hydraulic pressure of the pump 61 is made to act and a state in which the hydraulic pressure is released is connected to the two hydraulic chambers 48 and 49. Therefore, switching operation of the connection switching means 19 can be carried out by controlling the hydraulic pressure acting on the opposite end faces of the connecting piston 44. As a result, it is unnecessary to employ a return spring for urging the connecting piston 44 axially in one direction, thus reducing the number of components, and it is unnecessary to output a hydraulic pressure from the pump 61 that counteracts the urging force of the return spring, thus enabling the output hydraulic pressure of the pump 61 to be set at a relatively low value to improve the output efficiency of the engine.

Although an embodiment of the present invention has been described above, the present invention is not limited thereto and can be modified in a variety of ways without departing from the subject matter of the present invention described in the claims.

For example, in the above-mentioned embodiment, an explanation is given of the intake valve 6, which is an engine valve, but the present invention is also applicable to an exhaust valve, which is an engine valve.

What is claimed is:

1. A forced opening and closing valve operating system comprising:

a camshaft including a low speed valve-opening cam, a low speed valve-closing cam, a high speed valve-opening cam, and a high speed valve-closing cam, the low speed valve-opening cam and the low speed valve-closing cam having profiles corresponding to low speed running of an engine, the high speed valve-opening cam and the high speed valve-closing cam having profiles corresponding to high speed running of the engine;

a rocker shaft having an axis parallel to the camshaft;

a low-speed free rocker arm supported on the rocker shaft so as to swing by following the low speed valve-opening cam and the low speed valve-closing cam;

a high-speed free rocker arm supported on the rocker shaft so as to swing by following the high speed valve-opening cam and the high speed valve-closing cam;

a valve operating rocker arm swingably supported by the rocker shaft between the low-speed and high-speed free rocker arms, and connected to an engine valve so as to drive the engine valve in both valve-opening and valve-closing directions; and connection switching means provided in the rocker arms, the connection switching means switching so that the valve operating rocker arm is connected alternatively to the low-speed and high-speed free rocker arms.

2. The forced opening and closing valve operating system according to claim 1, wherein the connection switching means comprises a connecting piston having opposite ends facing a pair of hydraulic chambers while being capable of sliding in parallel to the axis of the rocker shaft between a position in which it provides a connection between the valve operating rocker arm and the low-speed free rocker arm and a position in which it provides a connection between the valve operating rocker arm and the high-speed free rocker arm, and wherein a control valve is connected to the two hydraulic chambers, the control valve switching alternatively between a state in which hydraulic pressure of a hydraulic pressure source is made to act and a state in which the hydraulic pressure is released.

3. The forced opening and closing valve operating system according to claim 1, further comprising a substantially T-shaped engagement arm extending toward the engine valve provided integrally with the valve operating rocker arm.

4. The forced opening and closing valve operating system according to claim 1, wherein the low-speed free rocker arm swingably supported on the rocker shaft comes into sliding contact with the valve operating rocker arm from one side along the axis of the rocker shaft.

5. The forced opening and closing valve operating system according to claim 4, wherein the high-speed free rocker arm swingably supported by the rocker shaft so as to be in sliding contact with the valve operating rocker arm from an opposite side along the axis of the rocker shaft.

6. The forced opening and closing valve operating system according to claim 2, further comprising a slide hole having an axis parallel to the rocker shaft provided in the valve operating rocker arm in a portion corresponding to valve opening rollers of the low-speed and high-speed free rocker arms and so that opposite ends of the slide hole are open, and the connecting piston is slidably fitted into the slide hole.

7. The forced opening and closing valve operating system according to claim 1, further comprising a dividing member inserted into and secured to the interior of the rocker shaft so as to divide the interior of the rocker shaft into a low-speed oil passage and a high-speed oil passage.

8. The forced opening and closing valve operating system according to claim 7, further comprising a low-speed communication hole provided in the rocker shaft for always providing communication between the low-speed oil passage and a low-speed communication passage formed in the low-speed free rocker arm.

9. The forced opening and closing valve operating system according to claim 1, further comprising a high-speed communication hole in the rocker shaft for always providing communication between the high-speed oil passage and a high-speed communication passage formed in the high-speed free rocker arm.

10. The forced opening and closing valve operating system according to claim 2, wherein the control valve switches alternatively between a state in which the hydraulic pressure of the hydraulic pressure source is made to act on one of two oil passages and the hydraulic pressure is released from the other one of the two oil passage, and a state in which the hydraulic pressure of the pump is made to act on said other one of the two oil passages and the hydraulic pressure is released from said one of the two oil passage.

11. A forced opening and closing valve operating system comprising:

a camshaft including a low speed valve-opening cam, a low speed valve-closing cam, a high speed valve-opening cam, and a high speed valve-closing cam, the low speed valve-opening cam and the low speed valve-closing cam having profiles corresponding to low speed running of an engine, the high speed valve-opening cam and the high speed valve-closing cam having profiles corresponding to high speed running of the engine;

a rocker shaft having an axis parallel to the camshaft;

a low-speed free rocker arm supported on the rocker shaft so as to swing by following the low speed valve-opening cam and the low speed valve-closing cam;

a high-speed free rocker arm supported on the rocker shaft so as to swing by following the high speed valve-opening cam and the high speed valve-closing cam;

a valve operating rocker arm swingably supported by the rocker shaft between the low-speed and high-speed free rocker arms, and connected to an engine valve so as to drive the engine valve in both valve-opening and valve-closing directions; and connection switching means provided in the rocker arms, the connection switching means switching so that the valve operating rocker arm is connected alternatively to the low-speed and high-speed free rocker arms, the connection switching means including two support shafts, one being secured into the low-speed free rocker arm, and the other being secured into the high-speed free rocker arm.

12. The forced opening and closing valve operating system according to claim 11, wherein the connection switching means comprises a connecting piston having opposite ends facing a pair of hydraulic chambers formed in the two support shafts while being capable of sliding in parallel to the axis of the rocker shaft between a position in which it provides a connection between the valve operating rocker arm and the low-speed free rocker arm and a position in which it provides a connection between the valve operating rocker arm and the high-speed free rocker arm, and wherein a control valve is connected to the two hydraulic chambers, the control valve switching alternatively between a state in which hydraulic pressure of a hydraulic pressure source is made to act and a state in which the hydraulic pressure is released.

13. The forced opening and closing valve operating system according to claim 11, further comprising a substantially T-shaped engagement arm extending toward the engine valve provided integrally with the valve operating rocker arm.

14. The forced opening and closing valve operating system according to claim 11, wherein the low-speed free rocker arm swingably supported on the rocker shaft comes into sliding contact with the valve operating rocker arm from one side along the axis of the rocker shaft.

15. The forced opening and closing valve operating system according to claim 14, wherein the high-speed free rocker arm 17 swingably supported by the rocker shaft so as to be in sliding contact with the valve operating rocker arm from an opposite side along the axis of the rocker shaft.

16. The forced opening and closing valve operating system according to claim 12, further comprising a slide hole having an axis parallel to the rocker shaft provided in the valve operating rocker arm in a portion corresponding to valve opening rollers of the low-speed and high-speed free rocker arms so that opposite ends of the slide hole are open, and the connecting piston is slidably fitted into the slide hole.

17. The forced opening and closing valve operating system according to claim 11, further comprising a dividing member inserted into and secured to the interior of the rocker shaft so as to divide the interior of the rocker shaft into a low-speed oil passage and a high-speed oil passage.

18. The forced opening and closing valve operating system according to claim 17, further comprising a low-speed communication hole provided in the rocker shaft for always providing communication between the low-speed oil passage and a low-speed communication passage formed in the low-speed free rocker arm.

19. The forced opening and closing valve operating system according to claim 11, further comprising a high-speed communication hole in the rocker shaft for always providing communication between the high-speed oil passage and a high-speed communication passage formed in the high-speed free rocker arm.

20. The forced opening and closing valve operating system according to claim 12, wherein the control valve switches alternatively between a state in which the hydraulic pressure of the hydraulic pressure source is made to act on one of two oil passages and the hydraulic pressure is released from the other one of the two oil passage, and a state in which the hydraulic pressure of the pump is made to act on said other one of the two oil passages and the hydraulic pressure is released from said one of the two oil passage.

* * * * *